United States Patent [19]

Edin et al.

[11] 4,021,769

[45] May 3, 1977

[54] ELECTRICAL HEATING ELEMENT

[75] Inventors: Ronald E. Edin, New Durham; Norman A. Mathieu, Exeter, both of N.H.

[73] Assignee: GTE Sylvania Incorporated, Danvers, Mass.

[22] Filed: Mar. 18, 1976

[21] Appl. No.: 667,915

[52] U.S. Cl. ..... 338/299; 219/548; 219/553; 338/325

[51] Int. Cl.[2] ..... H01C 3/14; H01C 7/22

[58] Field of Search ..... 338/208, 210, 299, 296, 338/325, 287; 219/538, 548, 549, 552, 553; 13/25

[56] References Cited

UNITED STATES PATENTS 3,469,013 9/1969 Hetherington et al. ..... 338/208 X

*Primary Examiner*—C. L. Albritton

*Attorney, Agent, or Firm*—James Theodosopoulos

[57] ABSTRACT

An elongated electrical heating element comprises intertwisted helical strands of metal wire. Some of the strands extend the full length of the heating element and other strands extend predetermined shorter distances to provide two or more zones having differing electric resistances and therefore differing operating temperatures.

2 Claims, 2 Drawing Figures

ELECTRICAL HEATING ELEMENT

This invention concerns electrical heating elements comprising intertwisted helical strands of metal wire. Such heating elements are disclosed in U.S. Pat. No. 3,178,665, the disclosure of which is incorporated herein by reference. In the heating elements disclosed therein, the individual helical strands extend the full length of the element, thereby providing substantially uniform electrical resistance throughout the length of the element.

In a heating element in accordance with this invention, the individual helical strands do not all extend the full length of the element. Instead, some strands run predetermined fractional amounts of the total element length in order to provide two or more longitudinal zones having different resistances and, therefore, different operating temperatures.

Figure 1:
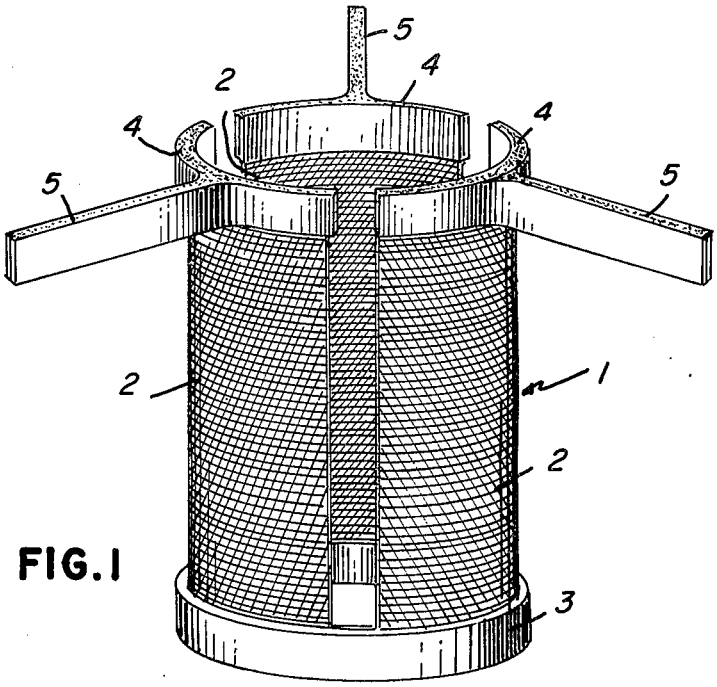
FIG. 1 is a perspective view of a heating element in accordance with this invention for use in a three phase furnace.
Figure 2:
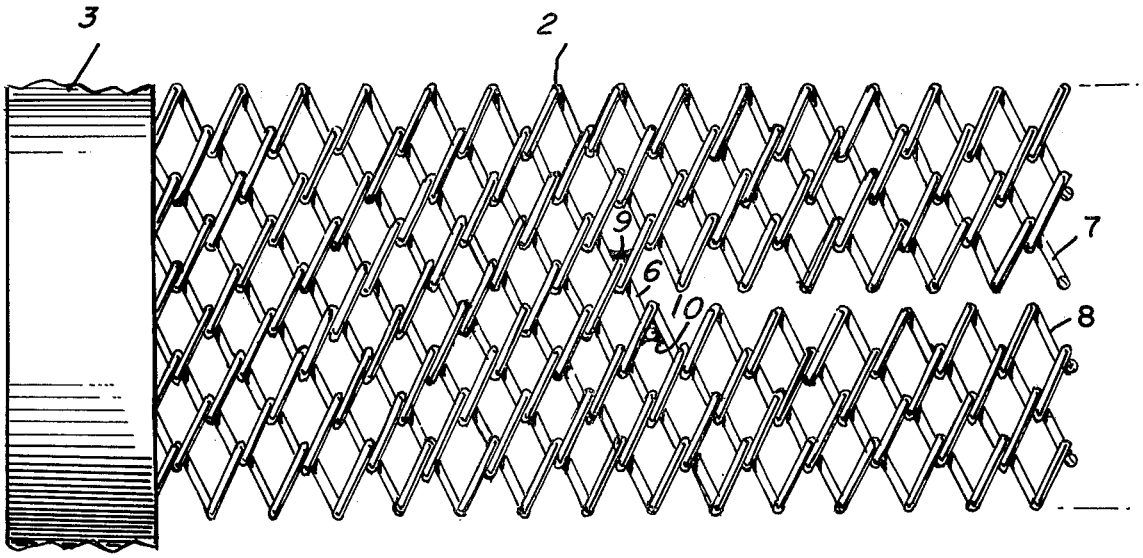
FIG. 2 is an expanded view showing part of the structure of one panel of the heating element.

In one embodiment of a heating element in accordance with this invention, as shown in FIGS. 1 and 2, heating element I comprised three panels 2 of intertwisted helical strands of tungsten wire. The lower edges of panels 2 were welded to a metal cylindrical ring 3 and the upper edges of each panel 2 were welded to a support band 4 which were each connected to a separate conducting arm 5, all as shown in U.S. Pat. No. 3,178,665.

Each panel consisted of 112 strands of 35 mil tungsten wire. Each strand was coiled on a 50 mil mandrel at 8 TPI. 90 of the strands extended the full length of the panel, which was 16 inches. There were 8 strands, scattered substantially uniformly throughout the 90 strands, which extended 10 inches from the bottom. In similar manner, there were another 7 strands which extended only 7 inches and another 7 strands which extended only 4 inches. The upper end of each of the 22 short strands was welded to each of its adjacent strands. Thus, the lower four inch region of the panel consisted of 112 strands and had the lowest electrical resistance. The next two regions, each 3 inches long, consisted of 105 and 98 strands respectively and had progressively higher resistances. The upper six inch region consisted of 90 strands and had the highest resistance.

FIG. 2 shows how a short strand 6 is welded to its adjacent strands 7 and 8 at points 9 and 10.

In operation, heating element 1, which was 16 inches long by 5 inches diameter, yielded four different temperature zones, the uppermost zone being the hottest. At 13 volts, 800 amperes, the lowest zone had a temperature of 1,580° C, the second and third zones had temperatures of 1,700° and 1,780°, respectively, the uppermost zone had a temperature of 1,850°.

For single phase electrical operation, the heater could have only one panel, cylindrical, made up of strands having two or more predetermined lengths to provide two or more regions having different temperatures.

We claim:

1. An elongated electrical heating element comprising intertwisted helical strands of metal wire, the turns of one of said strands being held by the turns of an adjacent strand, some of said strands extending the full length of the heating element and others of said strands extending only a predetermined fraction of said full length, those strands extending only a predetermined fraction of said full length being scattered substantially uniformly throughout those strands extending the full length of the heating element, so as to provide at least two longitudinally extending regions of said heating element having differing resistances and therefore differing operating temperatures.

2. The heating element of claim 1 wherein the ends of the shorter strands are welded to the adjacent strands.

* * * * *